United States Patent [19]

Wooten et al.

[11] Patent Number: 4,571,086

[45] Date of Patent: Feb. 18, 1986

[54] MIXING OF CERAMIC POWDERS

[75] Inventors: John R. Wooten, Chatsworth; Robert J. Walter, Thousand Oaks, both of Calif.; Thomas M. Shaw, Golden's Bridge, N.Y.

[73] Assignee: Rockwell International Corporation, El Segundo, Calif.

[21] Appl. No.: 654,427

[22] Filed: Sep. 26, 1984

[51] Int. Cl.[4] ..... B01F 11/02

[52] U.S. Cl. ..... 366/127; 210/748; 264/23

[58] Field of Search ..... 366/127, 1, 108, 116, 366/117, 118, 120, 349, 348, 2; 210/748; 209/5; 264/65, 23, 9, 69; 159/900

[56] References Cited

U.S. PATENT DOCUMENTS 4,071,225 1/1978 Holl ..... 366/127
4,307,964 12/1981 Dudgeon ..... 366/127
4,367,098 1/1983 McCord ..... 366/127
4,477,357 10/1984 Sittenfield ..... 210/748

OTHER PUBLICATIONS

A. Bleier, "Fundamentals of Preparing Suspensions of Silicon and Related Ceramic Powders", Communications of the American Ceramic Society, May 1983.

John S. Haggerty, W. Roger Cannon "Sinterable Powders from Laser Driven, pp. 79–81, Reactions, Third Annual Report", Jul. 1, 1970–Jun. 30, 1980, pp. 54–67.

*Primary Examiner*—Robert W. Jenkins

*Attorney, Agent, or Firm*—H. Fredrick Hamann; Harry B. Field

[57] ABSTRACT

A process of preparing ceramic powders for sintering comprises the steps of dispersing ceramic powders and sintering aids in a low-boiling dispersing liquid to form a suspension, ultrasonically vibrating the suspension to defloculate agglomerates which may have formed, and continuing the ultrasonic vibration until the dispersing liquid is evaporated.

3 Claims, 3 Drawing Figures

MIXING OF CERAMIC POWDERS

STATEMENT OF GOVERNMENT INTEREST

The Government has rights in this invention pursuant to Contract (or Grant) No. DASG-60-83-C-0057 awarded to the U.S. Department of the Army.

BACKGROUND OF THE INVENTION

1. Field of the Invention

This invention pertains to ceramics and more specifically to a method of mixing ceramic powders.

2. Description of the Prior Art

The strength of ceramics, as well as other physical, mechanical and dielectric properties, are controlled by the impurities and uniformity of the microstructure. Since ceramics are usually composed of several different compounds, it is necessary to thoroughly blend these powders together prior to sintering; this is accomplished by ball milling or other grinding techniques. Unfortunately, not only are impurities introduced into the starting powder which are detrimental to the sintered part, but also agglomerates form which preclude uniform mixing.

In copending application Ser. No. 558,225 filed Dec. 5, 1983, the inventors Walter et al teach another method for improving the strength of silicon nitride. That method comprises placing the silicon nitride object in a furnace in a gaseous atmosphere and subjecting the object to a hot isotatic pressing (HIP'ing) process at a temperature ranging from about 1600° to 1700° C.

Despite these improvements in the strength of ceramics, significant improvements are yet needed in order to make ceramics a more viable structural material.

Further, it should be known that Alan Bleier, in May 1983 Communications of the American Ceramic Society, authored an article entitled "Fundamentals of Preparing Suspensions of Silicon and Related Ceramic Powders". This article was directed at the use of specific kinds of dispersion liquids and recorded those which had good dispersion characteristics.

John S. Haggerty and W. Roger Cannon authored a paper entitled "Sinterable Powders from Laser Driven Reations, Third Annual Report", the report period being from July 1, 1979 through June 30, 1980. This report was prepared at the Massachusetts Institute of Technology for the U.S. Department of Defense. In that report, the authors discussed the use of dispersing liquids similar to those of Bleier above, and also at page 58 indicated that ultrasonic agitation could be used to enhance wetting, dispersion, and fragmentation of agglomerates.

SUMMARY OF THE INVENTION

Accordingly, there is provided a new process for mixing cermic powders prior to sintering. The process comprises the steps of dispersing the ceramic powders and sintering aids in a low boiling dispersing liquid to form a suspension, ultrasonically vibrating the suspension to defloculate agglomerates which may have formed, and continuing to ultrasonically vibrate until the solvent evaporates.

OBJECTS OF THE INVENTION

Therefore, it is an object of the present invention to provide a method for increasing the strength of ceramics.

Another object of the present invention is to provide a new method of preparing cermaics having homogeneous dispersion of the constituents.

Still another object of the present invention is to provide means for defloculating agglomerates which could otherwise impair the integrity of the sintered part.

Yet another object of the present invention is to provide a new means for mixing ceramics.

Other objects, advantages and novel features of the present invention will become apparent from the following detailed description of the invention when considered in conjunction with the accompanying drawing.

DETAILED DESCRIPTION OF THE PREFERRED EMBODIMENTS

Figure 1:
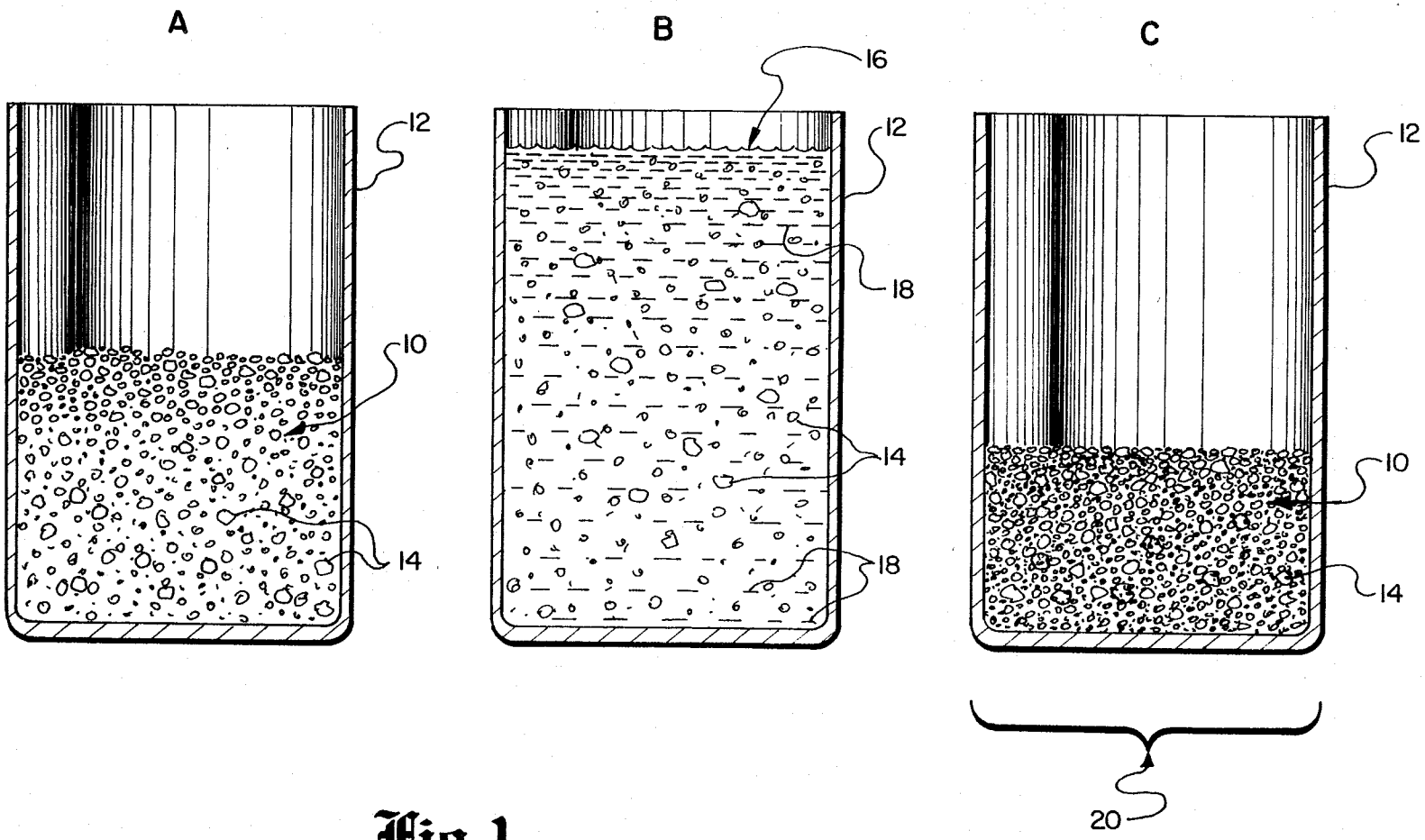
FIGS. 1*a*–1*c* are a pictorial sequence illustrating the powder preparation technique of the present invention.

In accordance with the present invention, unmilled ceramic powders 10 such as silicon nitride, $Si_3N_4$, silicon carbide, SiC, and aluminum oxide, $Al_2O_3$, are placed in a container 12 along with sintering aid 14. To this mixture there is added a sufficient amount of a low boiling dispersing liquids 16 such as the most preferred T-butyl alcohol, or other dispersing liquids such as low and high pH $H_2O$, methanol, ethanol, n-propanol, isopropanol, n-butanol, n-octanol, benzyl alcohol, ethylene glycol, acetone, 2-pentanone, 2-heptanone, and benzaldehyde to create a dispersion 18. The solids-to-liquid weight ratio can vary from about 1 to 20 to about 1 to 1. The dispersion is then subjected to ultrasonic vibrations for a sufficient time to break up, defloculate, the powder agglomerates which would otherwise not disperse. The dispersing liquid 16 is evaporated while the powder and sintering aids are being vibrated. The resultant material is a homogenous mixture 20 of ceramic powder 10 and sintering aids 14. This last step helps to insure a uniform mixing. Although the invention eliminates the need for ball milling of the ceramic powder, some milling may still be performed to reduce powder particle size to break up the soft agglomerates and to recompact the uniformly mixed powders in the powder after the fluid has been evaporated.

By way of example and not limitation, this method has been applied to the preparation of silicon nitride for sintering. The technique is pictorially shown in FIGS. 1*a*–1*c* wherein silicon nitride powder and sintering aids are placed into a container, FIG. 1*a*. The powder and sintering aids are then dispersed in T-butyl alcohol and vibrated ultrasonically to defloculate the hard and soft agglomerates, FIG. 1*b*. Ultrasonic vibration is continued while the dispersing solution is evaporated. The resultant material 20 is a homogenous mixture of dried ceramic powder 10 and sintering aids 14, FIG. 1*c*.

Obviously, many modifications and variations of the present invention are possible in light of the above teachings. It is therefore to be understood that, within the scope of the appended claims, the invention may be practiced otherwise than as specifically described.

What is claimed and desired to be secured by Letters Patent of the United States is:

1. A process of preparing ceramic powders prior to sintering, comprises the steps of:

dispersing a ceramic powder and sintering aids in a low-boiling dispersing liquid to form a suspension;

ultrasonically vibrating said suspension to defloculate agglomerates which may have formed; and continuing to ultrasonically vibrate the suspension until said dispersing liquid is evaporated.

2. The process of claim 1 wherein said dispersing liquid is selected from the group consisting of low and high pH water, methanol, ethanol, n-propanol, isopropanol, n-butanol, T-butyl alcohol, n-octanol, benzyl alcohol, ethylene glycol, acetone, 2-pentanone, 2-heptanone, and benzaldehyde.

3. The process of claim 2 wherein said dispersing liquid is T-butyl alcohol.

* * * * *